US009995081B1

(12) United States Patent
Shearman

(10) Patent No.: US 9,995,081 B1
(45) Date of Patent: Jun. 12, 2018

(54) SPACER ELEMENT FOR A DOUBLE GLAZED ARTICLE

(71) Applicant: The Folding Sliding Door Company LLC, Debary, FL (US)

(72) Inventor: Paul Anthony Shearman, Geneva, FL (US)

(73) Assignee: THE FOLDING SLIDING DOOR COMPANY LLC, Debary, FL (US)

( * ) Notice: Subject to any disclaimer, the term of this patent is extended or adjusted under 35 U.S.C. 154(b) by 0 days. days.

(21) Appl. No.: 15/474,548

(22) Filed: Mar. 30, 2017

(51) Int. Cl.

| | |
|---|---|
| ***E06B 3/263*** | (2006.01) |
| ***E06B 3/24*** | (2006.01) |
| ***E06B 1/36*** | (2006.01) |
| ***E06B 3/663*** | (2006.01) |
| ***E06B 3/964*** | (2006.01) |
| ***E06B 1/16*** | (2006.01) |

(52) U.S. Cl.
CPC ..... *E06B 3/24* (2013.01); *E06B 1/16* (2013.01); *E06B 1/36* (2013.01); *E06B 3/663* (2013.01); *E06B 3/9641* (2013.01); *E06B 3/9644* (2013.01)

(58) Field of Classification Search
CPC . E06B 3/24; E06B 1/16; E06B 3/9644; E06B 3/663; E06B 1/36; E06B 3/9641
See application file for complete search history.

(56) References Cited

U.S. PATENT DOCUMENTS

| | | | | |
|---|---|---|---|---|
| 3,425,163 | A * | 2/1969 | Horgan, Jr. | E05D 15/0665 49/413 |
| 8,464,467 | B2 * | 6/2013 | Lambertini | E06B 3/025 49/316 |
| 2009/0293366 | A1 | 12/2009 | Wefer | |
| 2014/0053488 | A1 * | 2/2014 | Lenox | E06B 3/26303 52/404.1 |

FOREIGN PATENT DOCUMENTS

| | | | |
|---|---|---|---|
| CH | 687474 | A5 | 12/1996 |
| DE | 102007005412 | A1 | 7/2008 |
| EP | 0608063 | A2 | 1/1994 |
| EP | 1249548 | A1 | 10/2002 |
| EP | 1389665 | A2 | 2/2004 |
| EP | 3192958 | A1 | 7/2017 |
| ES | 2589835 | A1 | 11/2016 |
| WO | 9621790 | A1 | 7/1996 |

* cited by examiner

*Primary Examiner* — Patrick J Maestri
(74) *Attorney, Agent, or Firm* — Stoel Rives, LLP

(57) ABSTRACT

A spacer element for a double glazed article, a kit for assembling the spacer element, and a double glazed article including the spacer element. The spacer element includes a frame section. The frame section has a first substantially planar mounting surface located on a first side of the frame section for mounting a first sheet of glass on the spacer element at a periphery of the first sheet of glass. The frame section also has a second substantially planar mounting surface located on a second side of the frame section opposite the first side, for mounting a second sheet of glass on the spacer element at a periphery of the second sheet of glass. The spacer element also has a cavity located in-between the first and second mounting surfaces for accommodating a lock and/or roller mechanism of the double glazed article at a periphery of the double glazed article.

10 Claims, 6 Drawing Sheets

SPACER ELEMENT FOR A DOUBLE GLAZED ARTICLE

TECHNICAL FIELD

This invention relates to a spacer element for a double glazed article, to a kit for assembling a spacer element for a double glazed article and to a double glazed article including a spacer element.

BACKGROUND

In the field of double glazed articles such as doors and windows, it is desirable to reduce, where possible, emissions towards the outside of a building incorporating the article.

A known kind of double glazed article can include a frame made up of spacer elements, which are mounted at the sides of a chamber defined between two sheets of glass. The spacer keeps the two sheets of glass separate, and can reduce linear heat transmission through the double glazed article.

Double glazed articles may typically be provided with features such as locks, roller mechanisms, hinges and weather seals.

SUMMARY

Aspects of the invention are set out in the accompanying independent and dependent claims. Combinations of features from the dependent claims may be combined with features of the independent claims as appropriate and not merely as explicitly set out in the claims.

According to an aspect of the invention, there is provided a spacer element for a double glazed article, the spacer element comprising:

a frame section having:

a first substantially planar mounting surface located on a first side of the frame section for mounting a major surface of a first sheet of glass on the spacer element at a periphery of the first sheet of glass; and a second substantially planar mounting surface located on a second side of the frame section opposite the first side, for mounting a major surface of a second sheet of glass on the spacer element at a periphery of the second sheet of glass; and a cavity located in-between the first mounting surface and a second surface of the frame section for accommodating a lock and/or roller mechanism of the double glazed article at a periphery of the double glazed article.

The provision of the first and second substantially planar mounting surfaces may allow for convenient mounting of the sheets of glass of a double glazed article in a spaced relationship. The provision of a cavity located in-between the first and second mounting surfaces can conveniently allow lock(s) and/or roller mechanism(s) to be installed at a periphery of the double glazed article. Since the cavity is located in-between the first and second mounting surfaces, whereby the lock(s) and/or roller mechanism(s) may be positioned in-between the sheets of glass, a compact construction may be achieved, without necessarily needing also to provide an external frame (for housing the lock(s) and/or roller mechanism(s)) that extends substantially beyond the periphery of the sheets of glass. The sheets of glass may accordingly extend closer to the edges of the double glazed article.

The frame section may include a first frame portion located on the first side of the frame section, the first frame portion including the first mounting surface. The frame section may also include a second frame portion located on the second side of the frame section, the second frame portion including the second mounting surface. The frame section may further include one or more connection members extending between the first frame portion and the second frame portion to connect the first frame portion and the second frame portion together. Each connection member may comprise a material having a lower thermal conductivity than a material of the first frame portion and the second frame portion. This arrangement may allow the first and second frame portions to comprise, for instance, a structurally strong material (e.g. a metal such as Aluminium), while also preventing significant thermal transfer through the frame section, owing to the lower thermal conductivity of the connection members that connect the first frame portion and the second frame portion together.

Each connection member may be removably connectable to the first frame portion and the second frame portion. This can allow convenient shipping and assembly (and disassembly) of the spacer element. This may also various different sizes of spacer element (for choosing a spacing between the sheets of glass) to be trialled.

The spacer element may have two of the connection members. The cavity for accommodating a lock or roller mechanism of the double glazed article may be located in-between the two connection members.

The spacer element may further include an elongate space located in or adjacent each mounting surface, for receiving an adhesive for securing the sheets of glass to the mounting surfaces. An adhesive may additionally (or instead) be located on the substantially planar mounting surfaces.

The spacer element may include a plurality of the frame sections. The spacer element may also include at least one connection piece for connecting together two of the frame sections. Each connection piece may include a plurality of male connectors. Each male connector may be configured to be received within an open end of each frame section located at either end of each frame section. This can allow convenient assembly of a spacer element that is suitably dimensioned for a particular application.

Each connection piece may be a corner connection piece having a first male connector oriented in a first direction and a second male connector oriented in a second direction substantially orthogonal the first direction, for connecting together two of the frame sections at a corner of the spacer element. This can allow convenient assembly of a spacer element that is suitably shaped for a particular application.

The male connectors of each connection piece may be configured to be received within an open end of the cavity of the spacer element located at either end of each frame section. In this way, the cavity may play the dual role of accommodating lock(s) and/or roller mechanism(s) and serving as part of the mechanism for connecting together the various frame sections of the spacer element.

Each frame section may include one or more female connection cavities separated from the cavity for accommodating a lock and/or roller mechanism. The male connectors of each connection piece may be configured to be received within an open end of the female connection cavities of each frame section located at either end of each frame section. The provision of separate cavities for receiving the male connectors of the connection pieces may prevent the male connectors from interfering with the lock(s) and/or roller mechanism(s).

The spacer element may have an outer flange portion for receiving hinges and/or weather seals of the double glazed article.

In embodiments in which the frame section includes:

a first frame portion located on the first side of the frame section, the first frame portion including the first mounting surface;

a second frame portion located on the second side of the frame section, the second frame portion including the second mounting surface; and one or more connection members extending between the first frame portion and the second frame portion to connect the first frame portion and the second frame portion together, wherein each connection member comprises a material having a lower thermal conductivity than a material of the first frame portion and the second frame portion, the frame portions may each include feet that extend at an angle substantially orthogonal the mounting surfaces of the frame section. The flange portion may be formed by the feet.

The spacer element may form a rectangular frame having four frame sections. Each edge of the rectangular frame may be formed by a respective one of the frame sections.

According to another aspect of the invention, there is provided a kit for assembling a spacer element comprising for a double glazed article, the spacer element comprising:

a frame section having:

a first substantially planar mounting surface located on a first side of the frame section for mounting a major surface of a first sheet of glass on the spacer element at a periphery of the first sheet of glass; and a second substantially planar mounting surface located on a second side of the frame section opposite the first side, for mounting a major surface of a second sheet of glass on the spacer element at a periphery of the second sheet of glass; and a cavity located in-between the first mounting surface and a second surface of the frame section for accommodating a lock and/or roller mechanism of the double glazed article at a periphery of the double glazed article, wherein the kit comprises:

a plurality of the frame sections; and at least one connection piece for connecting together two of the frame sections, wherein each connection piece comprises a plurality of male connectors, wherein each male connector is configured to be received within an open end of each frame section located at either end of each frame section.

The frame section may include a first frame portion located on the first side of the frame section. The first frame portion may include the first mounting surface. The frame section may also include a second frame portion located on the second side of the frame section. The second frame portion may include the second mounting surface. The frame section may further include one or more connection members extending between the first frame portion and the second frame portion to connect the first frame portion and the second frame portion together. Each connection member may comprise a material having a lower thermal conductivity than a material of the first frame portion and the second frame portion. The kit may further include a plurality of the connection members. At least some of the connection members may be differently dimensioned, for selecting a spacing between the first sheet of glass and the second sheet of glass.

According to a further aspect of the invention, there is provided a double glazed article comprising:

spacer element comprising:

a frame section having:

a first substantially planar mounting surface located on a first side of the frame section for mounting a major surface of a first sheet of glass on the spacer element at a periphery of the first sheet of glass; and a second substantially planar mounting surface located on a second side of the frame section opposite the first side, for mounting a major surface of a second sheet of glass on the spacer element at a periphery of the second sheet of glass; and a cavity located in-between the first mounting surface and a second surface of the frame section for accommodating a lock and/or roller mechanism of the double glazed article at a periphery of the double glazed article;

a first sheet of glass mounted on the first substantially planar mounting surface; and a second sheet of glass mounted on the second substantially planar mounting surface.

The double glazed article may, for instance, be a double glazed door or window.

BRIEF DESCRIPTION OF THE DRAWINGS

Embodiments of the present invention will be described hereinafter, by way of example only, with reference to the accompanying drawings in which like reference signs relate to like elements and in which.

DETAILED DESCRIPTION OF PREFERRED EMBODIMENTS

Embodiments of the present invention are described in the following with reference to the accompanying drawings.

Figure 1:
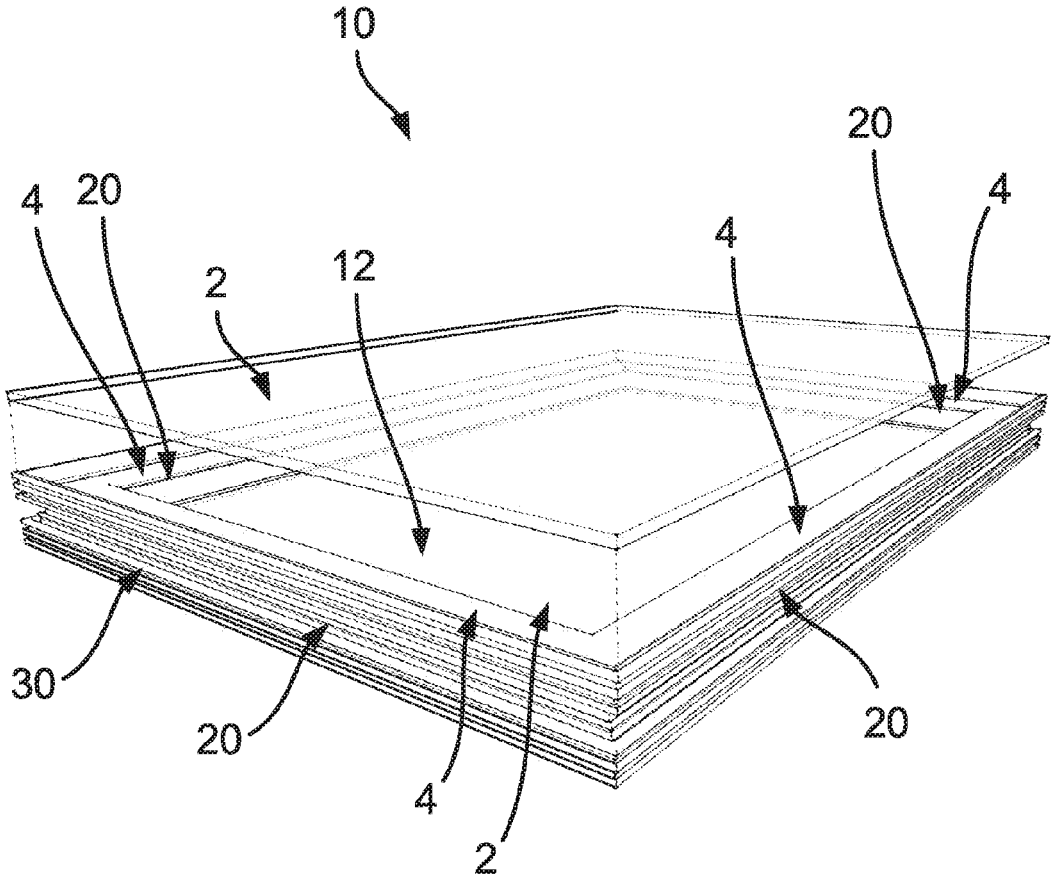
FIG. 1 shows a double glazed article such as a door or window, incorporating a spacer element according to an embodiment of this invention.

FIG. 1 shows an example of a double glazed article 10 according to an embodiment of this invention. The double glazed article 10 may, for instance, be a double glazed door or window.

The double glazed article 10 includes a spacer element 30. The spacer elements described herein generally include one or more frame sections that may be joined together to form a frame to support the sheets of glass included in a double glazed article. The frame formed by the spacer element 30 may, for instance be rectangular (e.g. oblong, square). In the embodiment of FIG. 1, the spacer element 30 includes four frame sections 20. Each frame section 20 may be of generally similar construction. As can be seen in FIG. 1, in the present embodiment, each frame section 20 extends along a respective edge of the double glazed article 10. The frame sections 20 of the spacer element 30 connected together at the corners of the double glazed article 10. Details as to how this connection may be implemented will be described in more detail below.

The double glazed article 10 includes first and second sheets of glass 2. In FIG. 1, the one of the sheets of glass 2 (the upper sheet of glass 2, as viewed in FIG. 1) is shown to be removed from the spacer element 30, so as to reveal the underlying features of the double glazed article 10.

Each frame section 20 includes two substantially planar mounting surfaces 4 for mounting the glass on the spacer element 30. The substantially planar mounting surfaces 4 of each frame section 20 are substantially parallel to each other. The substantially planar mounting surfaces 4 are located on opposite sides of each frame section 4 so that the two sheets of glass 2 of the double glazed article 10 can be mounted in a spaced relationship on opposite sides of the spacer element 30. The spacer element 30 can thus act to space apart the sheets of glass 2, thereby to form a cavity 12 between them. As will be described below, a lateral width of the frame sections 20 may be selected/adjusted in order to choose the depth of the cavity 12 between the two sheets of glass 2. Note that the frame sections themselves from a boundary around the cavity 12 at the periphery of the double glazed article 10.

Note that the spacer element 30 and the frame sections 20 may be substantially symmetrical about a plane located equidistant and parallel to the two sheets of glass 2. In FIG. 1 the mounting surfaces 4 on a first side (an upper side, as viewed in FIG. 1) of each of the frame sections 20 is shown. The mounting surfaces 4 of each of the frame sections 20 is located on a lower side of the spacer element 30 as viewed in FIG. 1.

As can be seen in FIG. 1, the mounting surfaces 4 of the frame sections 20 meet at the joins between the frame sections 20 (i.e. at the corners of the double glazed article in this embodiment). This forms a common substantially planar mounting surface for each sheet of glass 2, each common substantially planar mounting surface including the mounting surfaces 4 located on each side of the frame sections 20 of the spacer element 30. The mounting surfaces 4 of each frame section 20 can each allow the sheets of glass 2 to be mounted at their periphery to the spacer element 30. In particular, a mounting surfaces 4 of each frame section 20 can be mounted to the inwardly facing (with respect to the double glazed article 10) major surfaces of each sheet of glass 2, along a respective edge of each sheet of glass 2.

As will be described in more detail below, a cavity is located in-between the two mounting surfaces 4 of each frame section 20. This cavity may accommodate a lock and/or roller mechanism at a periphery of the double glazed article 10.

Figure 2:
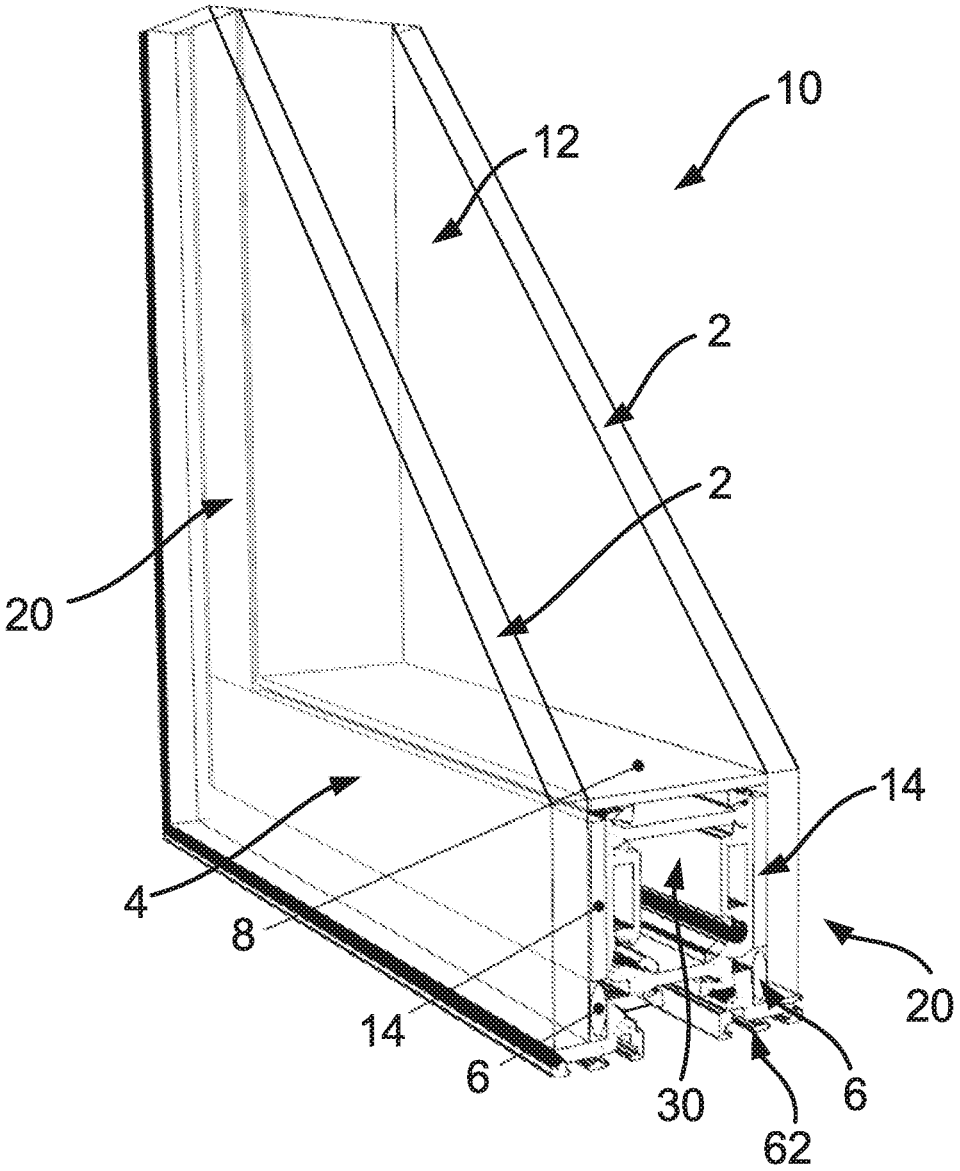
FIG. 2 shows a part of the double glazed article of FIG. 1 in more detail.

FIG. 2 shows a cut away view of a corner part of the double glazed article of FIG. 1 in more detail. The cavity 12 located between the first and second sheets of glass 2, and the way in which the spacer element 30 separates the glass 2 to form the cavity 12 can be seen more clearly in FIG. 2. As also shown in FIG. 2, the spacer element may be provided with inwardly facing portions 8, which bound the edges of the cavity 12. These parts 8, which may for instance comprise foam or plastic dress the cavity 12, so that the underlying frame sections 20 cannot be seen from outside the double glazed article 10.

FIG. 2 also shows that the spacer element 30 in this example includes a flange 62. The flange 62 is located on an outwardly facing, outer peripheral edge of the spacer element 30 (e.g. facing in an opposite direction to the inwardly facing portions 8. The flange 62 is suitable for receiving hinges and/or weather seals of the double glazed article 10. The flange 62 can also provide support for the ends of each sheet of glass 2.

As mentioned previously, the first and second sheets of glass 2 are mounted on mounting surfaces 4 of the frame sections 20 of the spacer element 30. In order to implement the mounting of the glass 2, adhesive 14 comprising, for instance, adhesive construction foam or rubber may be provided on the sides of the frames sections 20. In particular, the adhesive 14 may be situated on the mounting surfaces 4 of the frame sections 20.

In addition to, or instead of the adhesive 14, adhesive 6 may be provided in an elongate space located in-between the edges of the sheets of glass 2 and the frame sections 20. For instance, the adhesive 6 may be positioned in the corners formed by the mounting surfaces 4 of the frame sections 20 and the flange 62. The adhesive 6 can further strengthen the attachment of the glass 2 to the frame sections 20. In embodiments that do not include the adhesive 14, the adhesive 6 alone may serve to fix the glass 2 to the mounting surfaces 4 of the frame sections 20.

Figure 3:
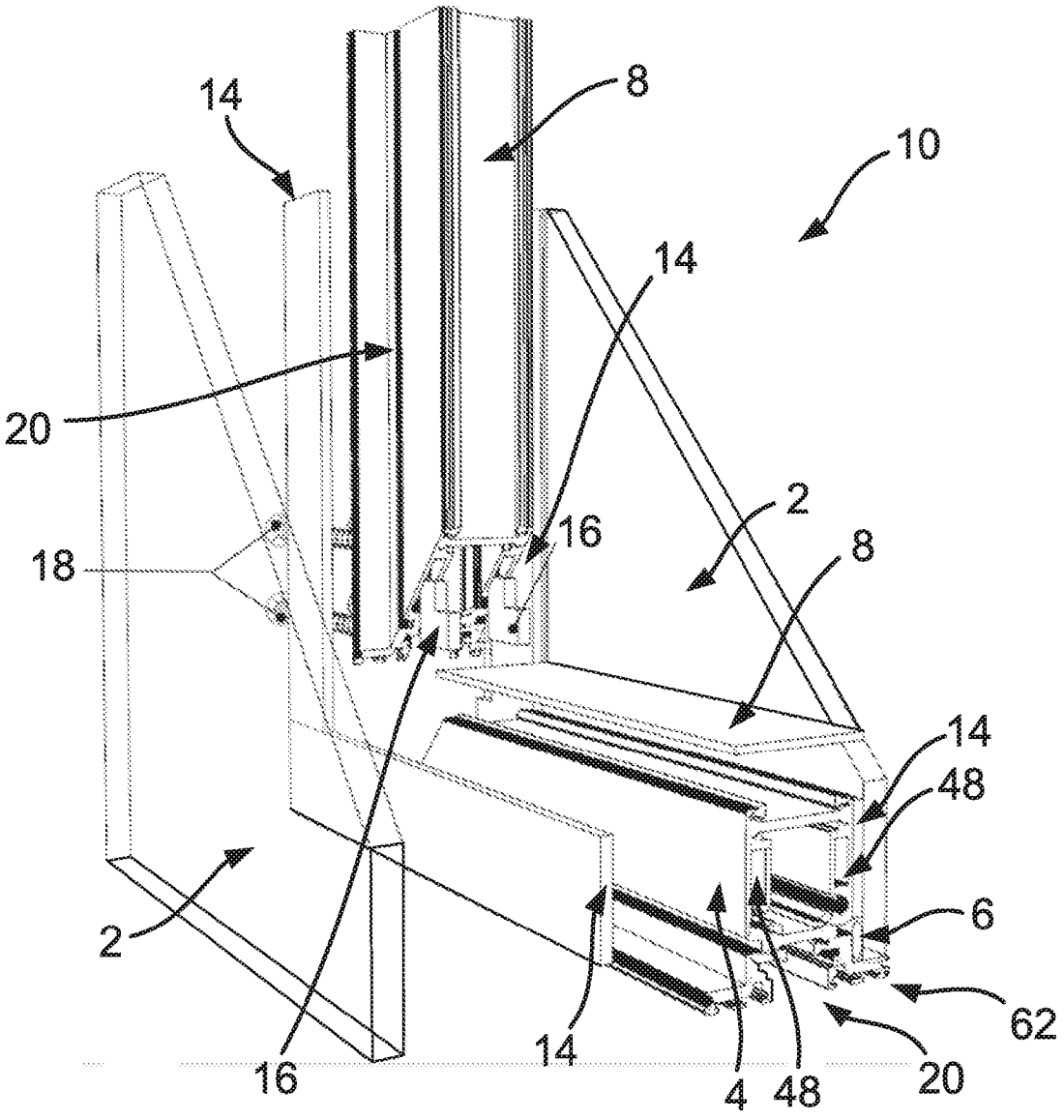
FIG. 3 shows an exploded view of the part of the double glazed article of FIG. 2.

FIG. 3 shows an exploded view of the part of the double glazed article 10 shown in FIG. 2. The way in which the joins between the frame sections 20 at the corners of the double glazed article 10 can be seen more clearly in this exploded view.

In the present embodiment, the spacer element 30 includes a plurality of connection pieces 16 for connecting the frame sections 20 together. Each connection piece 16 comprises a plurality of male connectors, which are configured to be received within an open end of each frame section 20. The connection pieces 16 shown in FIG. 3 are substantially L-shaped, for connecting together two frame sections 20 to form a corner of the spacer element 30. To implement this corner connection, the ends of the frame section 20 to be connected together at the corner of the spacer element 30 may be cut of a forty five degree angle, as can be seen in FIG. 3. It is also envisaged that the connection pieces may be substantially linear, for connecting together two substantially parallel frame sections 20, to form a longer frame section.

As can be seen in FIG. 3, in this embodiment, each L-shaped connection piece 16 includes a first male connector oriented in a first direction and a second male connector oriented in a second direction substantially orthogonal the first direction, for connecting the frame sections 20 together. In this embodiment, the male connectors of the connection pieces 16 are inserted into the open ends of separate female connection cavities 48, which run along the length of the interior of each frame section 20.

The connection pieces 16 can allow the ends of each frame section 20 to be mated together. Further measures may be taken to secure the frame sections 20 together. For instance, adhesive may be used at the ends of each frame section 20 and/or around the connection pieces 16. In the present example, fixings such as screws 18 may be used. These screws can be screwed into the screw holes 50 shown in more detail in FIG. 4.

Figure 4:
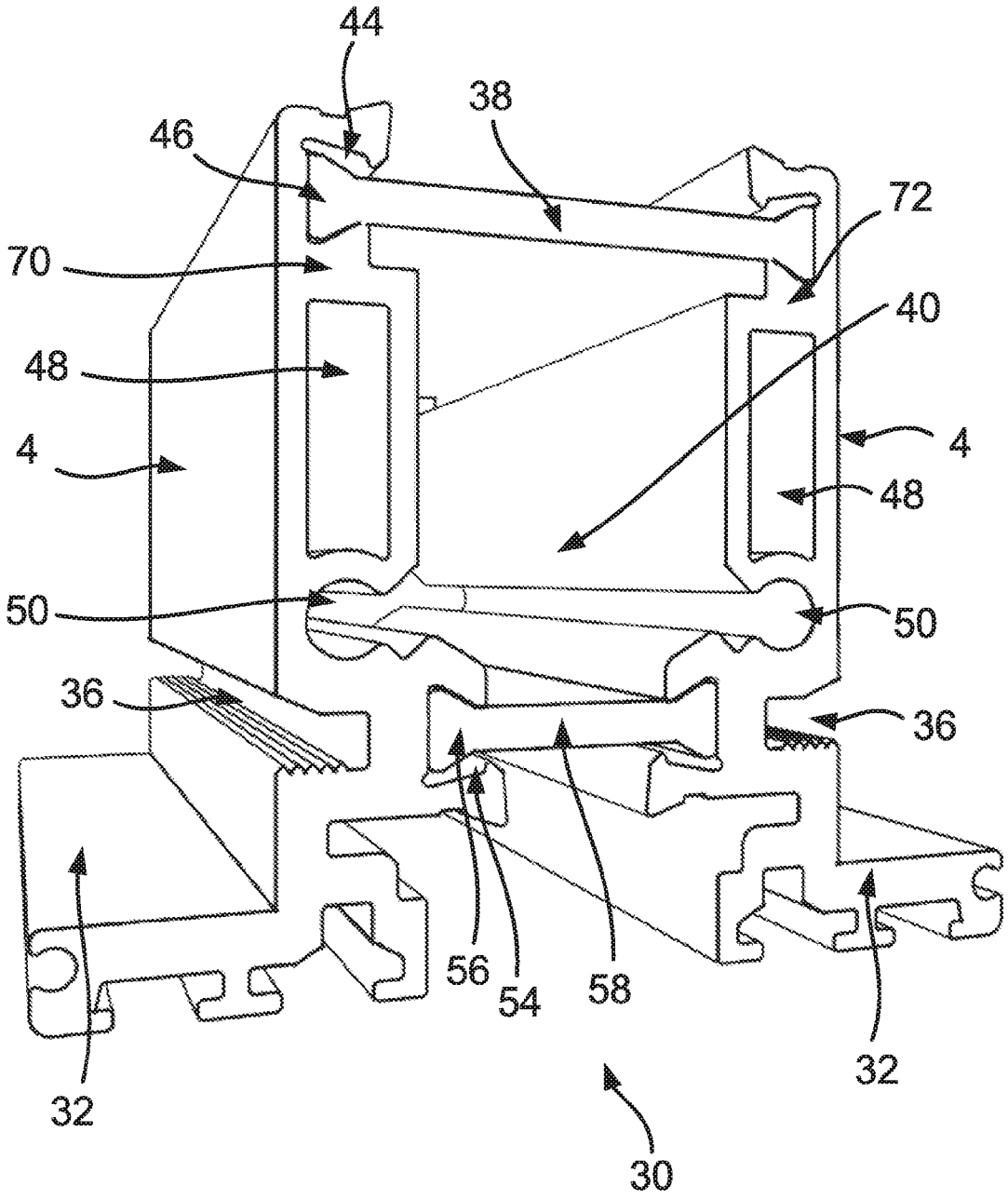
FIG. 4 shows a detailed view of a frame section of a spacer system for use in a double glazed article according to an embodiment of this invention.

FIG. 4 shows a detailed view of the frame section 20 of the present embodiment in more detail. The frame section 20 in this example comprises a first frame portion 70 and a section frame portion 72. Each frame portion 70, 72 may be shaped and dimensioned similarly, so that the frame section 20 is substantially symmetrical.

The first frame portion 70 is located on a first side of the frame section 20, and includes the first mounting surface 4 of the frame section 20. The second frame portion 72 is located on a second side of the frame section 20, and includes the second mounting surface 4 of the frame section 20.

The frame portions 70, 72 may comprise a rigid material such as a metal (e.g. Aluminium), high-strength plastic, fibre glass, and the like, to provide robust and secure mounting surfaces for the sheets of glass 2.

The frame portions 70, 72 of the frame section 20 are positioned in a spaced relationship, with a cavity 40 located in between them. In the assembled double glazed article 10, the cavity 40 may be aligned with, and extend around the outer periphery of the cavity 12. The cavity 40 may be separated from the cavity 12 by the aforementioned inwardly facing portions 8. As shown in FIG. 4, the cavity 40 is located between the located in-between the mounting surfaces 4 of the frame portion 72. In this way, the cavity 40 may be located between the first and second sheets of glass 2 of the assembled double glazed article 10, around the periphery of the glass 2.

The cavity 40 may serve to thermally insulate the first frame portion 70 from the second frame portion 72, improving the thermal performance of the double glazed article 10. The cavity 40 may also accommodate further features of the double glazed article 10. In particular, it is envisaged that the cavity 40 may accommodate one or more lock(s) and/or roller mechanism(s) of the double glazed article 10 at a periphery of the double glazed article 10. Since the cavity 40 is located in-between the first and second mounting surfaces 4, whereby the lock(s) and/or roller mechanism(s) may be positioned in-between the sheets of glass 2, a compact construction may be achieved, without necessarily needing also to provide an external frame (for housing the lock(s) and/or roller mechanism(s)) that extends substantially beyond the periphery of the sheets of glass 2. The sheets of glass 2 may accordingly extend closer to the edges of the double glazed article 10.

The frame section 20 may also include one or more connection members extending between the first frame portion 70 and the second frame portion 72 to connect the first frame portion 70 and the second frame portion 72 together. The connection members may extend through the cavity 40. In some examples, the connection members may bound the cavity 40. The connection members may extend in a direction substantially perpendicular to the mounting surfaces 4. The connection members may also extend along the length of the interior of each frame section 20. In the present embodiment, the frame section 20 includes two connection members including an inner connection member 38, and an outer connection member 58. In the assembled double glazed article 10, the inner connection member 38 is located in between the outer connection member 58 and the cavity 12.

Each connection member may be formed from a material that has a lower thermal conductivity than a material forming the first frame portion 70 and the second frame portion 72. This arrangement may allow the first and second frame portions 70, 72 to comprise, for instance, a structurally strong material (e.g. a metal such as Aluminium as noted above), while also preventing significant thermal transfer through the frame section 20, owing to the lower thermal conductivity of the connection members 38, 58. The connection members 38, 58 may, for instance, comprise a plastic material such as polyamide.

The connection members 38, 58 may be removably connectable to the first and second frame portions 70, 72. In the present example, the frame portions 70, 72 each includes grooves 44, 54, which run along the length of each frame portion 70, 72 on a surface of each frame portion 70, 72 opposite the mounting surface 4 of that frame portion 70, 72. The grooves 44, 54 are shaped to receive the edges of the inner connection member 38 and outer connection member 58, respectively. As shown in FIG. 4, the edges of the connection members 38, 58 may be tapered to flare outwardly 46, 56, to oppose their removal from the grooves 44, 54. The inner surfaces of the grooves 44, 54 may be shaped to match the shape of the flared edges 46, 56 of the connection members 38, 58. The connection members 38, 58 may be attached to the frame portions 70, 72 by sliding them into the grooves 44, 54 starting at one end of the frame portions 70, 72. Instead of sliding the connection members 38, 58 by sliding them into the grooves 44, 54, the connection members may alternatively be pressed into place in the grooves 44, 54.

FIG. 4 also shows the female connection cavities 48 and screw holes 50 in more detail. These may run along the length of each frame portion 70, 72 and may have open ends at either end of each frame portion 70, 72 for receiving the screws 18 and connection pieces 16.

As noted above, each frame section 20 may include a flange 62. In the present example, the frame portions 70, 72 each comprise feet 32 that extend at an angle substantially orthogonal to the mounting surfaces 4 of the frame section 20. These feet 32 form the flange 62. As noted previously, the flange 62 is suitable for receiving hinges and/or weather seals of the double glazed article 10. The feet 32 may be shaped to facilitate the attachment of these features to the double glazed article 10. In the present embodiment, the frame sections are each also provided with a groove 36 located between the feet 32 and the mounting surfaces 4, again to allow the mounting of features such as hinges and/or weather seals.

Figure 5:
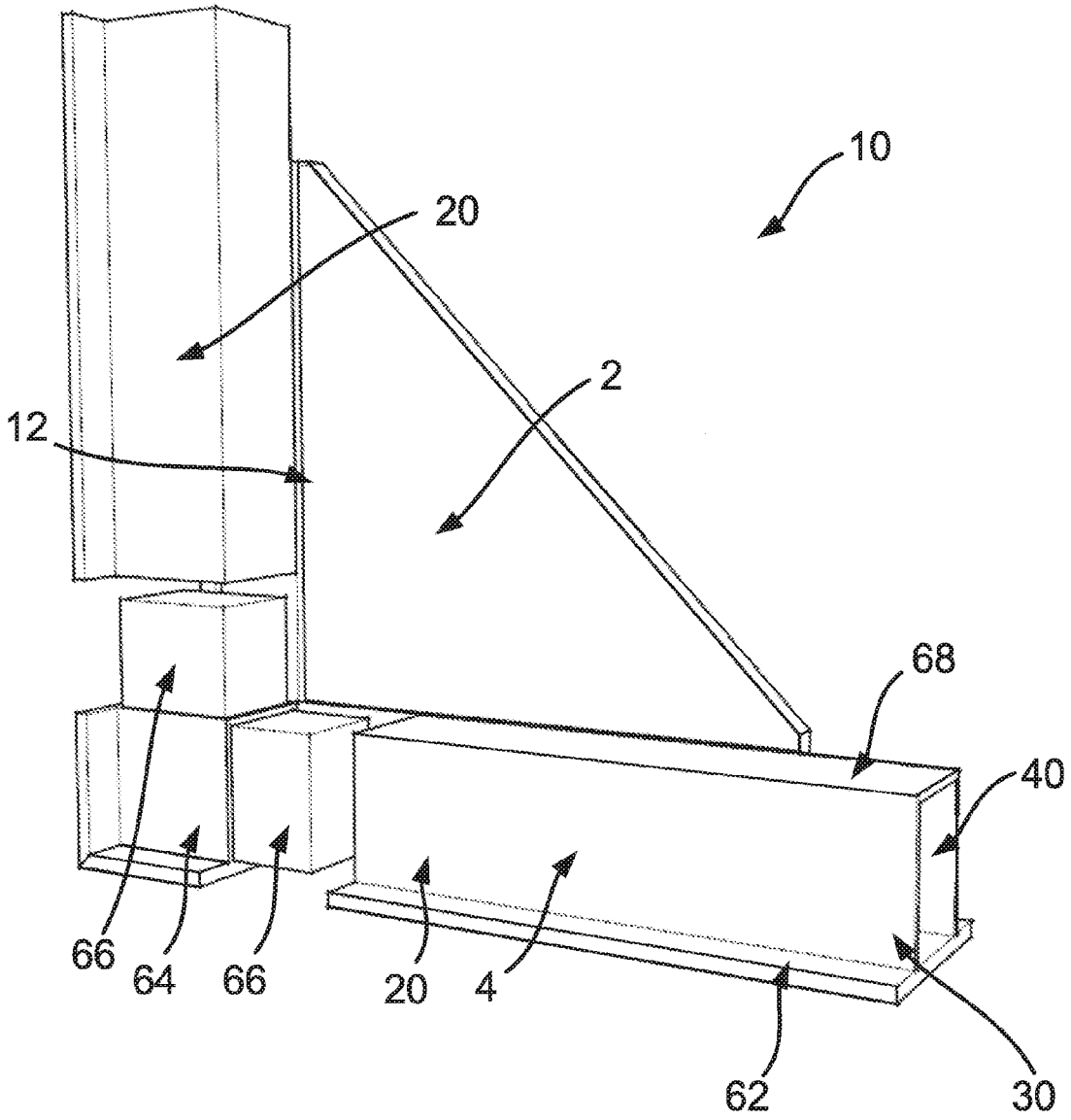
FIG. 5 shows a part of a double glazed article such as a door or window, incorporating a spacer element according to another embodiment of this invention.

FIG. 5 shows a part of a double glazed article 10 such as a door or window, incorporating a spacer element 30 according to another embodiment of this invention.

As with the first embodiment, the double glazed article includes a spacer element 30, which is made up of one or more frame sections 20. In this embodiment, each frame section 20 may be formed from a single piece, unlike the frame sections 20 described in the first embodiment, which comprise first and second frame portions 70, 72. The frame sections 20 of the present embodiment may have a substantially rectangular cross section (e.g. square, or oblong as shown in FIG. 5) when viewed end-on.

Each frame section 20 has a first substantially planar mounting surface 4 located on a first side thereof, and a second substantially planar mounting surface 4 located on a second, opposite side thereof. The planar mounting surfaces 4 are substantially parallel. As described in relation to the first embodiment, these mounting surfaces 4 can allow a first sheet of glass 2 and a second sheet of glass 2 to be mounted in a spaced relationship on the spacer element 30 at a periphery of each sheet of glass 2, to form a cavity 12 between them.

As described previously, the frame section 20 of the present embodiment may also include a cavity 40, which is located in-between the first mounting surface 4 and a second surface 4 of the frame section 20. Again, this cavity 40 may serve to thermally insulate the first frame portion 70 from the second frame portion 72, improving the thermal performance of the double glazed article 10. Again, the cavity 40 may also accommodate further features of the double glazed article 10. In particular, it is envisaged that the cavity 40 may accommodate one or more lock(s) and/or roller mechanism(s) of the double glazed article 10 at a periphery of the double glazed article 10. Since the cavity 40 is located in-between the first and second mounting surfaces 4, whereby the lock(s) and/or roller mechanism(s) may be positioned in-between the sheets of glass 2, a compact construction may be achieved, without necessarily needing also to provide an external frame (for housing the lock(s) and/or roller mechanism(s)) that extends substantially beyond the periphery of the sheets of glass 2. The sheets of glass 2 may accordingly extend closer to the edges of the double glazed article 10.

As described above, the spacer element 30 may inwardly facing portions 68, which bound the edges of the cavity 12 and which dress the frame sections 20.

As shown in FIG. 5, the frame sections 20 may include a flange 62. In this embodiment, the flange 62 may be formed by an outer peripheral wall of the cavity 40 extending out beyond the mounting surfaces 4. As with the first embodiment, the flange 62 is thus located on an outwardly facing, outer peripheral edge of the spacer element 30 (e.g. facing in an opposite direction to the inwardly facing portions 68. Again, the flange 62 is suitable for receiving hinges and/or weather seals of the double glazed article 10. Again, the flange 62 can also provide support for the ends of each sheet of glass 2.

In the present embodiment, the spacer element 30 includes a plurality of connection pieces 64 for connecting the frame sections 20 together. Each connection piece 64 comprises a plurality of male connectors 66, which are configured to be received within an open end of each frame section 20. The connection pieces 64 shown in FIG. 5 are substantially L-shaped, for connecting together two frame sections 20 to form a corner of the spacer element 30. It is also envisaged that the connection pieces 64 may be substantially linear, for connecting together two substantially parallel frame sections 20, to form a longer frame section.

As can be seen in FIG. 5, in this embodiment, each L-shaped connection piece 64 includes a first male connector 66 oriented in a first direction and a second male connector 66 oriented in a second direction substantially orthogonal the first direction, for connecting the frame sections 20 together. In this embodiment, the male connectors of the connection pieces 16 are inserted into the open ends of the cavity 40 which may run along the length of the interior of each frame section 20. Note that in this example, no separate female connection cavities 48 of the kind described above may be required, making for a simpler construction.

The connection pieces 64 can allow the ends of each frame section 20 to be mated together. Further measures may be taken to secure the frame sections 20 together. For instance, the male connectors 66 may be coated with adhesive before inserting into the ends of the cavities 40 of the frame sections. In the present embodiment, the connection pieces 66 can be located in the corners of the assembled double glazed article 10. Note that the connection pieces 64 may include flanges which correspond to the flanges 62 of the frame sections 20. Again, these flanges can provide additional support for each sheet of glass 2.

The frame sections 20 and/or connection pieces 64 in this embodiment may comprise a rigid material such as a metal (e.g. Aluminium), high-strength plastic, fibre glass, and the like, to provide robust and secure mounting surfaces for the sheets of glass 2.

Figure 6:
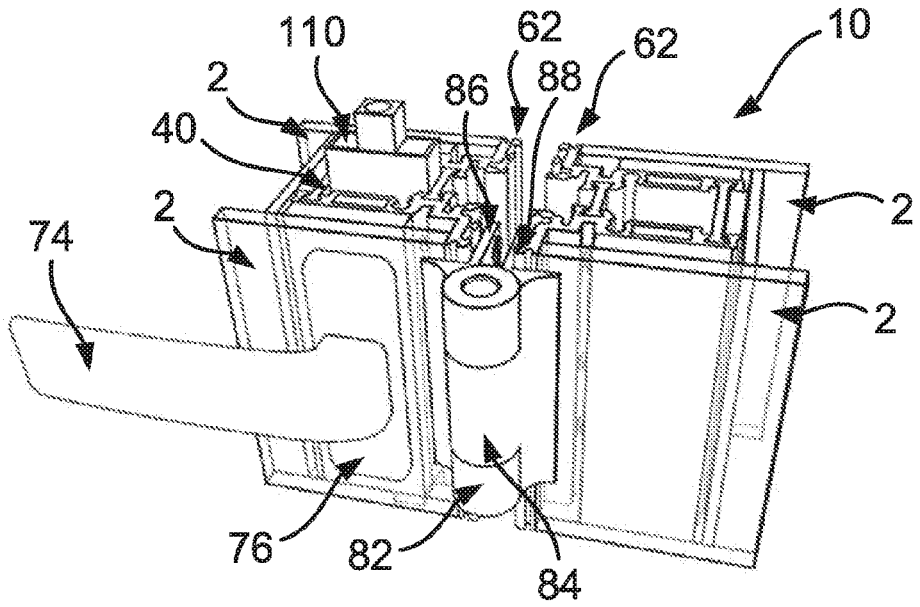
FIG. 6 shows an example of how a flange of a double glazed article, such as a door or window, may receive a hinge in accordance with an embodiment of this invention.

FIG. 6 shows an example of how a flange 62 of a double glazed article 10, such as a door or window, may receive a hinge in accordance with an embodiment of this invention. As can be seen in FIG. 6, this can allow two parts of the double glazed article 10 (each part comprising, for instance, a spacer element 30 of the kind described previously) to be attached together by the hinge, so that they may pivot around the hinge while the door or window is being opened or closed.

In this example, the hinge includes a first side 82 and a second side 84. The first side and the second side 84 are pivotably attached together. The first side 82 includes a plate 86 and the second side 84 includes a plate 88. The plates 86, 88 may each be positioned so that they extend substantially parallel to the flange 62 of a respective one of the two spacer elements that are to be connected together by the hinge. The plates 86, 88 may be attached to the flanges 62 using fixing such as screws. In the present example, the plates 86, 88 are attached to only one of the feet 32 of each flange 62, although it is envisaged that the plates 86, 88 may extend along the side of each spacer element 30 so as to be attached to both feet 32 of each flange 62.

FIG. 6 also shows how a lock 110, such as an espagnolet lock, may be received in the cavity 40 of one of the spacer elements 30. As shown in FIG. 6, the lock 110 in this example is located in between in-between the connection members 38, 58 described previously.

FIG. 6 further shows how a handle 74 may be attached to one of the spacer elements 30. As shown in FIG. 6, the handle 74 may be attached to a base 76. One or more openings or holes may be formed in one of the sheets of glass 2 in order to allow the handle 74 to be connected to the lock 110.

Figure 7A:
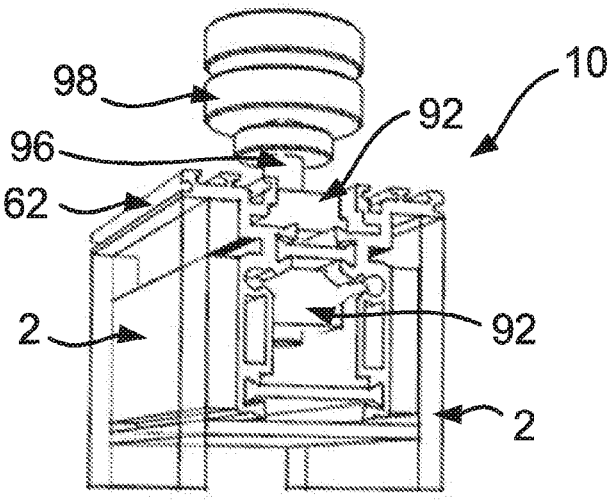
FIG. 7A shows a part of a double glazed article such as a door or window, demonstrating how a roller mechanism may be accommodated in the cavity of the spacer element according to an embodiment of this invention.

FIG. 7A shows a part of a double glazed article 10 such as a door or window, demonstrating how a roller mechanism may be accommodated in the cavity 40 of the spacer element 30 according to an embodiment of this invention. In this example, the roller mechanism is vertical roller mechanism comprising one or more rollers 98, each mounted on a respective axle 96. The axles 96 may be mounted on a mounting block 92. As shown in FIG. 7A, at least part of the mounting block 92 is located in the cavity 40. The mounting block 92 may be shaped to conform with the walls of the cavity 40. The mounting block 92 may extend through an opening or break in one of the connection members 58, to allow it to extend in a middle region of the cavity 40.

Figure 7B:
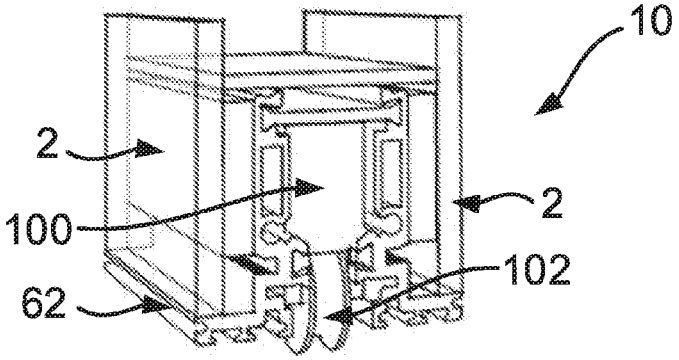
FIG. 7B shows a part of a double glazed article such as a door or window, demonstrating how a roller mechanism may be accommodated in the cavity of the spacer element according to another embodiment of this invention.

FIG. 7B shows a part of a double glazed article 10 such as a door or window, demonstrating how a roller mechanism may be accommodated in the cavity 40 of the spacer element 30 according to another embodiment of this invention. In this example, the roller mechanism is a horizontal roller mechanism comprising one or more rollers 102 mounted on a mounting block 100. As shown in FIG. 7B, at least part of the mounting block 100 is located in the cavity 40. The mounting block 100 may be shaped to conform with the walls of the cavity 40. The mounting block 100 may extend through an opening or break in one of the connection members 58, to allow it to extend in a middle region of the cavity 40. Note that in this example, the roller(s) 102 are located at least partially inside the cavity 40.

In accordance with an embodiment of this invention, there may be provided a kit of parts, which may be assembled to form a spacer element 30 of the kind described herein. The kit may include one or more frame sections 20 of the kind described above and at least one connection piece 16 or connection piece 64 for connecting the frame sections 20 together to assembly the spacer element 30. The kit may also include:

lock(s) and/or roller mechanism(s) that may be installed in the cavity 40 between the substantially planar mounting surfaces 4 of one or more of the frame sections 20;

hinges and/or weather seals that may be installed on the flange 62 of one or more of the frame sections 20;

a plurality of sheets of glass 2 to be mounted on the mounting surfaces 4 of the frame sections 20 of spacer element 30;

adhesive for mounting the sheets of glass 2 on the mounting surfaces 4 of the frame sections 20 of the spacer element 30, and/or any tools that may be required for assembling the spacer element 30 and for mounting the sheets of glass 2.

The kit may also include one or more connection members 38, 58 of the kind described above in relation to the embodiment of FIGS. 2 to 4 (refer in particular to FIG. 4), to allow frame portions 70, 72 of each frame section 20 to be connected together. As described above, at least some of the connection members 38, 58 in the kit may be differently dimensioned, for selecting a spacing between the first sheet of glass 2 and the second sheet of glass 2.

As described above, it is envisaged that the frame section(s) 20 of the kit may be pre-cut to a particular size. Alternatively, the frame section(s) 20 of the kit may be cut to size during assembly of the spacer element. One or more frame sections 20 in the kit may be cut into multiple smaller (shorter) frame sections 20 as part of the assembly process.

Accordingly, there has been described a spacer element for a double glazed article, a kit for assembling the spacer element, and a double glazed article including the spacer element. The spacer element includes a frame section. The frame section has a first substantially planar mounting surface located on a first side of the frame section for mounting a first sheet of glass on the spacer element at a periphery of the first sheet of glass. The frame section also has a second substantially planar mounting surface located on a second side of the frame section opposite the first side, for mounting a second sheet of glass on the spacer element at a periphery of the second sheet of glass. The spacer element also has a cavity located in-between the first and second mounting surfaces for accommodating a lock and/or roller mechanism of the double glazed article at a periphery of the double glazed article.

Aspects of the invention are defined in the following series of numbered clauses.

1. A spacer element for a double glazed article, the spacer element comprising:

a frame section having:

a first substantially planar mounting surface located on a first side of the frame section for mounting a major surface of a first sheet of glass on the spacer element at a periphery of the first sheet of glass; and a second substantially planar mounting surface located on a second side of the frame section opposite the first side, for mounting a major surface of a second sheet of glass on the spacer element at a periphery of the second sheet of glass; and a cavity located in-between the first mounting surface and a second surface of the frame section for accommodating a lock and/or roller mechanism of the double glazed article at a periphery of the double glazed article.

2. The spacer element of clause 1, wherein the frame section comprises:

a first frame portion located on the first side of the frame section, the first frame portion including said first mounting surface;

a second frame portion located on the second side of the frame section, the second frame portion including said second mounting surface; and one or more connection members extending between the first frame portion and the second frame portion to connect the first frame portion and the second frame portion together, wherein each connection member comprises a material having a lower thermal conductivity than a material of the first frame portion and the second frame portion.

3. The spacer element of clause 2, wherein each connection member is removably connectable to the first frame portion and the second frame portion.

4. The spacer element of clause 3, comprising two said connection members, wherein the cavity for accommodating a lock or roller mechanism of the double glazed article is located in-between the connection members.

5. The spacer element of any preceding clause, further comprising an elongate space located in or adjacent each said mounting surface, for receiving an adhesive for securing the sheets of glass to said mounting surfaces.

6. The spacer element of any preceding clause comprising:

a plurality of said frame sections; and at least one connection piece for connecting together two of said frame sections, wherein each connection piece comprises a plurality of male connectors, wherein each male connector is configured to be received within an open end of each frame section located at either end of each frame section.

7. The spacer element of clause 6, wherein each connection piece is a corner connection piece having a first male connector oriented in a first direction and a second male connector oriented in a second direction substantially orthogonal the first direction, for connecting together two of said frame sections at a corner of the spacer element.

8. The spacer element of clause 6 or clause 7, wherein the male connectors of each connection piece are configured to be received within an open end of the cavity of the spacer element located at either end of each frame section.

9. The spacer element of clause 6 or clause 7, wherein each frame section includes one or more female connection cavities separated from said cavity for accommodating a lock and/or roller mechanism, and wherein the male connectors of each connection piece are configured to be received within an open end of the female connection cavities of each frame section located at either end of each frame section.

10. The spacer element of any preceding clause comprising an outer flange portion for receiving hinges and/or weather seals of the double glazed article.

11. The spacer element of clause 10 when dependent upon any of clauses 2 to 4, wherein the frame portions each comprise feet that extend at an angle substantially orthogonal the mounting surfaces of the frame section, wherein the flange portion is formed by said feet.

12. The spacer element of any preceding clause, wherein the spacer element forms a rectangular frame comprising four said frame sections, wherein each edge of the rectangular frame is formed by a respective one of said frame sections.

13. A kit for assembling a spacer element according to any preceding clause, the kit comprising:

a plurality of said frame sections; and at least one connection piece according to any of clauses 6 to 9.

14. The kit of clause 13, further comprising a plurality of connection members according to any of clauses 2 to 4, wherein at least some of the connection members are differently dimensioned, for selecting a spacing between the first sheet of glass and the second sheet of glass.

15. A double glazed article comprising:

a spacer element according to any of clauses 1 to 12;

a first sheet of glass mounted on the first substantially planar mounting surface; and a second sheet of glass mounted on the second substantially planar mounting surface.

Although particular embodiments of the invention have been described, it will be appreciated that many modifications/additions and/or substitutions may be made within the scope of the claimed invention.

It will be obvious to those having skill in the art that many changes may be made to the details of the above-described embodiments without departing from the underlying principles of the invention. The scope of the present invention should, therefore, be determined only by the following claims.

The invention claimed is:

1. A spacer element for a double glazed article, the spacer element comprising:

a frame section having:

a first frame portion located on the first side of the frame section, the first frame portion including a first planar mounting surface located on a first side of the frame section for mounting a major surface of a first sheet of glass on the spacer element at a periphery of the first sheet of glass; and a second frame portion located on the second side of the frame section, the second frame portion including a second planar mounting surface located on a second side of the frame section opposite the first side, for mounting a major surface of a second sheet of glass on the spacer element at a periphery of the second sheet of glass; and two connection members extending between the first frame portion and the second frame portion to removably connect the first frame portion and the second frame portion together, wherein each connection member comprises a material having a lower thermal conductivity than a material of the first frame portion and the second frame portion; and a cavity, wherein the cavity is located in-between the first mounting surface and the second mounting surface of the frame section and wherein the cavity is located in-between the connection members; and a lock or a roller mechanism at least partially located in the cavity in-between the first mounting surface and the second mounting surface and in-between the connection members.

2. The spacer element of claim 1, further comprising an elongate space located in or adjacent each said mounting surface, for receiving an adhesive for securing the sheets of glass to said mounting surfaces.

3. The spacer element of claim 1 comprising:

a plurality of said frame sections; and at least one connection piece for connecting together two of said frame sections, wherein each connection piece comprises a plurality of male connectors, wherein each male connector is configured to be received within an open end of each frame section located at either end of each frame section.

4. The spacer element of claim 3, wherein each connection piece is a corner connection piece having a first male connector oriented in a first direction and a second male connector oriented in a second direction orthogonal the first direction, for connecting together two of said frame sections at a corner of the spacer element.

5. The spacer element of claim 3, wherein the male connectors of each connection piece are configured to be received within an open end of the cavity of the spacer element located at either end of each frame section.

6. The spacer element of claim 3, wherein each frame section includes one or more female connection cavities separated from said cavity for accommodating a lock or roller mechanism, and wherein the male connectors of each connection piece are configured to be received within an open end of the female connection cavities of each frame section located at either end of each frame section.

7. The spacer element of claim 1 comprising an outer flange portion for receiving hinges or weather seals of the double glazed article.

8. The spacer element of claim 7, wherein the frame portions each comprise feet that extend at an angle orthogonal the mounting surfaces of the frame section, wherein the flange portion is formed by said feet.

9. The spacer element of claim 1, wherein the spacer element forms a rectangular frame comprising four said frame sections, wherein each edge of the rectangular frame is formed by a respective one of said frame sections.

10. A double glazed article comprising:

a spacer element comprising:

a frame section having:

a first frame portion located on the first side of the frame section, the first frame portion including a first planar mounting surface located on a first side of the frame section for mounting a major surface of a first sheet of glass on the spacer element at a periphery of the first sheet of glass; and a second frame portion located on the second side of the frame section, the second frame portion including a second planar mounting surface located on a second side of the frame section opposite the first side, for mounting a major surface of a second sheet of glass on the spacer element at a periphery of the second sheet of glass; and two connection members extending between the first frame portion and the second frame portion to removably connect the first frame portion and the second frame portion together, wherein each connection member comprises a material having a lower thermal conductivity than a material of the first frame portion and the second frame portion; and a cavity, wherein the cavity is located in-between the first mounting surface and the second mounting surface of the frame section and wherein the cavity is located in-between the connection members; and a lock or a roller mechanism located at a periphery of the double glazed article, wherein the lock or the roller mechanism is at least partially located in the cavity in-between the first mounting surface and the second mounting surface and in-between the connection members;

a first sheet of glass mounted on the first planar mounting surface; and a second sheet of glass mounted on the second planar mounting surface.

* * * * *